United States Patent [19]

Niemi

[11] 4,302,110

[45] Nov. 24, 1981

[54] MIXING APPARATUS

[75] Inventor: Ossi Niemi, Tampere, Finland

[73] Assignee: Flowcon Oy, Kirkkonummi, Finland

[21] Appl. No.: 88,190

[22] Filed: Oct. 25, 1979

[30] Foreign Application Priority Data

Oct. 27, 1978 [FI] Finland ..... 783276

[51] Int. Cl.[3] ..... B28C 5/12; B01F 7/00; B01F 15/02

[52] U.S. Cl. ..... 366/41; 193/23; 366/65; 366/150; 366/288; 414/299

[58] Field of Search ..... 193/23, 29; 414/269, 414/272, 299, 300, 302; 366/30, 41, 65, 68, 150, 177, 178, 181, 244, 287, 288, 347; 141/284

[56] References Cited

U.S. PATENT DOCUMENTS

| | | | |
|---|---|---|---|
| 1,413,505 | 4/1922 | Stump | 193/23 |
| 2,793,837 | 5/1957 | Goldman | 366/287 X |
| 3,080,033 | 3/1963 | Scott et al. | 193/23 |
| 3,447,698 | 6/1969 | Sackett, Sr. | 193/23 X |
| 3,827,578 | 8/1974 | Hough | 193/23 X |
| 4,107,789 | 8/1978 | McDowell | 366/30 X |

*Primary Examiner*—Philip R. Coe

*Attorney, Agent, or Firm*—Finnegan, Henderson, Farabow, Garrett & Dunner

[57] ABSTRACT

A concrete mixing apparatus with a stationary mixing container and an upper circular cover plate arranged to rotate in relation to said container. The apparatus is provided with a machinery for rotating said cover plate and with a discharge channel for one or several materials. The discharge channel is arranged above the cover plate in substantially coaxial relation thereto. The apparatus further comprises a filling channel, the lower end of which is fastened onto said cover plate and the upper end of which is arranged in substantially coaxial relation to said discharge channel.

4 Claims, 7 Drawing Figures

MIXING APPARATUS

This invention relates to a mixing apparatus and more particularly to a filling channel arrangement for mixers having a stationary mixing container in which the cover plate of the container rotates guided by or journalled onto the container construction.

According to one arrangement of this kind the components to be mixed are rationed into the container from above by means of a channel arrangement extending to the vertical axis of the container. The arrangement comprises a substantially stationary container having the form of a circular trough or having an open inner space, a cover means rotating around the vertical axis of the container, and at least one filling channel associated with the rotating cover means.

Concrete mixers are usually equipped with containers having the form of a circular trough or having an open inner space. The container can be stationary or rotatable around a vertical or horizontal axis. A stationary container is in many respects better than a rotating container construction but the filling of material components takes place in a rather disadvantageous manner. When using stationary container constructions, the upper cover means of the mixer has usually to be constructed rotatable whereby different kinds of mixing tools can be fastened thereon. The diameter of the cover means is usually at least 70 percent of the outer diameter of the container such that the components to be mixed have to be introduced near the outer edge of the stationary container through a fixed channel associated with the container. This arrangement has the following drawbacks:

In a container, the outer diameter of which can be 1 to 4 meters and even more, depending on the mixing volume, a material accumulation takes place near the filling channel, said accumulation, however, evening out in the container.

The necessary mixing time is rather long as the material layer to be mixed is uneven and heterogenous.

The mixing channel associated with the container is usually rather narrow in the radial direction of the container wherefore the filling of the mixer is slow.

It is the object of this invention to eliminate the above drawbacks and to create a filling channel arrangement of a new type.

The invention is based on the idea that the filling channel is associated with the rotating cover means of the mixing container such that at least some part of the material to be mixed is introduced coaxially or nearly coaxially with the vertical axis of the mixer into the rotating upper part of the filling channel. It then flows through the rotating cover means into the container at a desired distance from the vertical axis of the container.

More specifically, the arrangement according to the invention is characterized by the fact that there is at least one filling channel fastened onto the cover such that its upper part is connected in an at least substantially coaxial manner with a discharge channel for at least one material.

By means of the arrangement according to the invention, substantial advantages are achieved as compared to previous filling channel constructions. Hence, the materials to be mixed can be introduced as an even flow into the container. When mixing several components at the same time, an efficient mixing operation starts immediately. The mixing time becomes shorter. The filling channel or channels can be made big enough. The filling channel or channels stay cleaner than before as they can be located at sites which are better protected from splashing.

The invention will be explained in more detail by means of the embodiments presented in the attached drawings.

Figure 1:
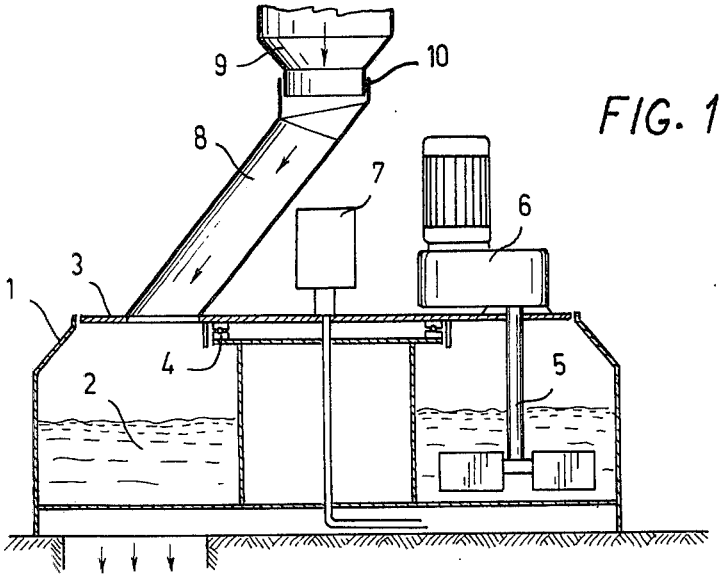
FIG. 1 is a sectional view of a typical mixer of the circular trough container type.
Figure 2:
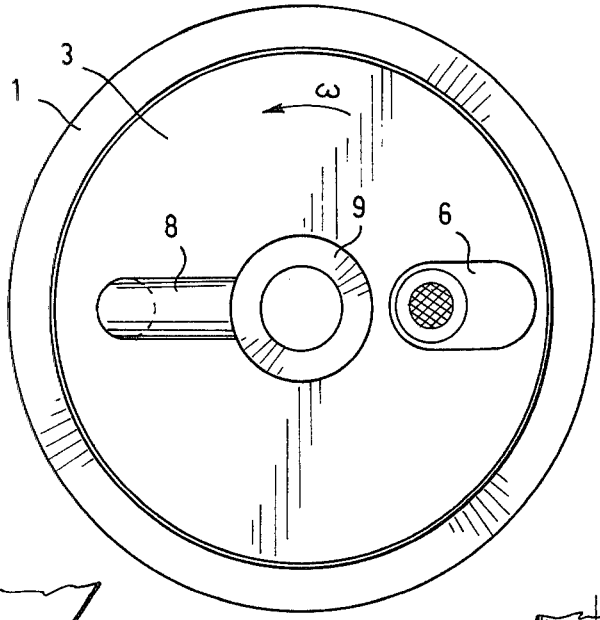
FIG. 2 shows the mixer according to FIG. 1 from above.

The embodiments of FIGS. 1, 2, 3, and 4 are provided with a stationary mixing container 1 and a rotating cover plate 3 journalled thereon by means of bearing means 4. The mixing machinery or machineries 6, together with the mixing tools 5, are fastened onto the cover plate 3. Filling channel 8 (8*a*, 8*b*) is fastened onto the cover plate 3 and accordingly rotates therewith. Part 9 is a stationary filling funnel or the upper part of a material discharge channel in general.

Figure 3:
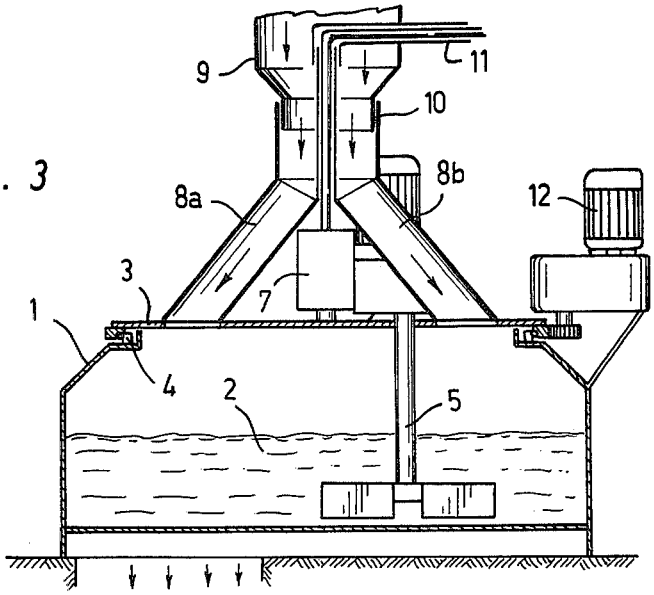
FIG. 3 is a sectional view of a mixer of the open type.

In FIGS. 1 and 3 there are in addition shown the mixing chamber 2, the rotatable connecting means 7 (e.g., a gliding unit) required by the mixing machineries, as well as the movable sealing 10 between the fixed part 9 and the rotating filling channel 8 (8*a*, 8*b*).

Figure 4:
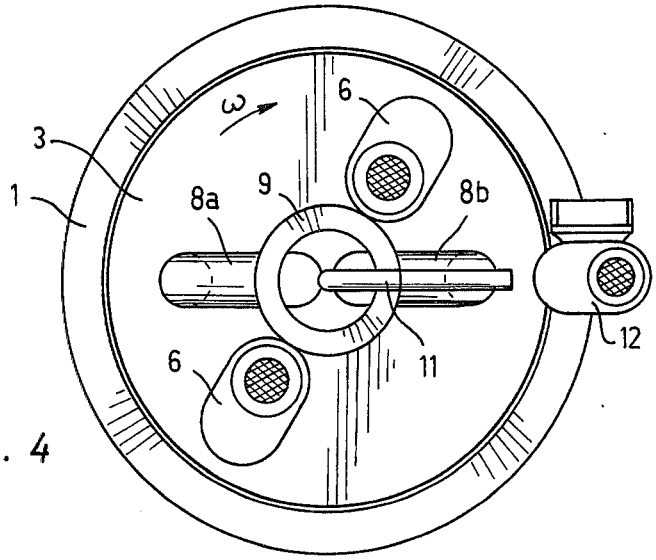
FIG. 4 shows the mixer according to FIG. 3 from above.

FIGS. 3 and 4 show in addition how, e.g., a cable can be introduced into part 7 by means of a protecting tube 11 and how the rotating machinery 12 for the plate 3 can be fastened onto the container 1.

Figure 5:
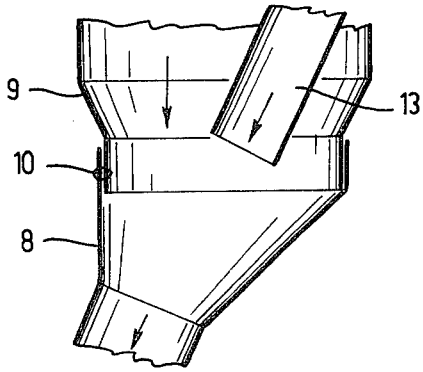
FIG. 5 shows one embodiment of the upper part of a filling channel.

FIG. 5 shows how an additional material discharge channel 13 can be associated with part 9.

Figure 6:
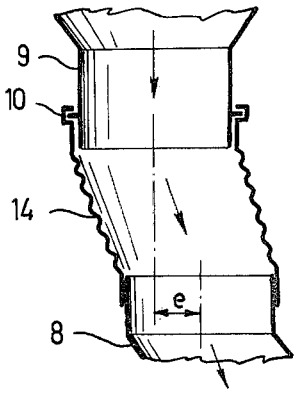
FIGS. 6 and 7 show different embodiments of a filling funnel and a filling channel.

FIG. 6 shows a resilient coupling element 14 between parts 8 and 9, whereby parts 8 and 9 do not have to be on the same vertical axis but they can show a considerable eccentricity (e).

An alternative solution would be such that part 14 is journalled in a slidable manner both between parts 8 and 9, in which case part 14 can be also rigid.

Figure 7:
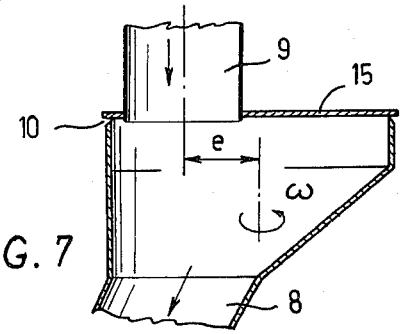

FIG. 7 shows how plate 15 associated with part 9 can function as a locking and sealing means when part 9 is situated in an eccentric manner (e) in relation to the rotation center.

I claim:

1. A mixing apparatus comprising:

(a) a stationary mixing container;

(b) an upper circular cover plate for said container, said cover plate having an upper side and an under side and being arranged to rotate continuously around a central vertical axis in relation to said stationary mixing container;

(c) means for rotating said cover plate;

(d) a discharge channel for at least one material, arranged above said cover plate in substantially coaxial relation thereto;

(e) at least one filling channel having a lower end fastened onto said cover plate and an upper end;

(f) means at said upper end of said at least one filling channel for receiving said material from said discharge channel;

(g) at least one mixing tool rotatably arranged on said under side of said cover plate at a distance from said central vertical axis so as to move along a circular path within said mixing container during the rotation of said cover plate; and (h) means for rotating said mixing tool, said rotating means being arranged on said upper side of said cover plate.

2. The mixing apparatus in claim 1 wherein said connecting means is resilient.

3. The mixing apparatus in claim 1 wherein said connecting means is rigid.

4. The mixing apparatus in claim 1 including only a single filling channel and wherein said mixing tool is situated substantially diametrically opposite said lower end of said single filling channel on said cover plate.

* * * * *